US007470146B1

(12) United States Patent
Chen

(10) Patent No.: US 7,470,146 B1
(45) Date of Patent: Dec. 30, 2008

(54) AUDIO JACK ASSEMBLY

(75) Inventor: Po-Jung Chen, Taoyuan County (TW)

(73) Assignee: U.D. Electronic Corp., Taoyuan County (TW)

( * ) Notice: Subject to any disclaimer, the term of this patent is extended or adjusted under 35 U.S.C. 154(b) by 0 days.

(21) Appl. No.: 12/119,508

(22) Filed: May 13, 2008

(51) Int. Cl.
*H01R 13/73* (2006.01)

(52) U.S. Cl. ..... 439/541.5

(58) Field of Classification Search ..... 439/541.5, 439/668, 669, 607
See application file for complete search history.

(56) References Cited

U.S. PATENT DOCUMENTS 6,887,099 B1 * 5/2005 Tung ..... 439/541.5
7,008,261 B2 * 3/2006 Xue et al. ..... 439/541.5
7,361,062 B2 * 4/2008 Long et al. ..... 438/668

* cited by examiner

*Primary Examiner*—Phuong K Dinh

(57) ABSTRACT

An audio jack assembly includes an electrically insulative housing that has plug holes for the insertion of a respective audio plug and multiple sets of terminal slots corresponding to the plug holes, terminal sets respectively mounted in the terminal slots, each terminal set including a grounding terminal, two signal terminals and two switching terminals, each terminal having a base for mounting, a spring arm and/or a retaining portion, and a locating block fastened to the back side of the housing to hold multiple leads in vertical lead grooves thereof, the leads having a top end press-fitted into engagement with the retaining portion of one terminal and a bottom end for bonding to an external motherboard beneath the housing and the locating block.

14 Claims, 9 Drawing Sheets

AUDIO JACK ASSEMBLY

BACKGROUND OF THE INVENTION

1. Field of the Invention

The present invention relates to audio jacks and more particularly, to an audio jack assembly, which utilizes modularized terminals for the connection of leads by means of press-fitting, simplifying the installation procedure and saving much the cost.

2. Description of the Related Art

A multimedia player (stereo, PC or DVD player) has speakers connected thereto for voice output. The number of the speakers is determined subject to the number of audio output channels of the multimedia player. For example, a music CD player has a left channel and a right channel for output of stereo sound. A computer may be equipped with an AC '97 5.1 sound card to provide 5 discrete channels and one low frequency channel for audio output through a respective speaker. In 2004 Analia was created for delivering high-definition audio that is capable of playing back more channels at higher quality than previous integrated audio codecs like AC '97.

Further, a multimedia player generally has an audio connector (audio jack assembly) provided at its motherboard, and the audio connector has one or a number of plug holes for the insertion of a respective audio plug for audio output. FIG. 8 is an exploded view of an audio jack assembly according to the prior art. According to this design, the audio jack assembly comprises an electrically insulative housing A that has a plurality of vertically spaced accommodation chambers A2 and a plurality of plug holes A1 respectively disposed corresponding to the accommodation chambers, and multiple terminal sets respectively accommodated in the accommodation chambers A2. Each terminal set includes signal terminals B and switching terminals C. Each signal terminal B has a base B1 mounted in one accommodation chamber A2 of the electrically insulative housing A, and a bonding endpiece B2 backwardly extending from the back side of the base B1 for bonding to a circuit board. Each switching terminal C has a base C1 mounted in one accommodation chamber C2 of the electrically insulative housing A, and a bonding endpiece C2 backwardly extending from the back side of the base C1 for bonding to a circuit board. When an audio plug is inserted into one plug hole A1, the switching terminals C of the respective terminal set are electrically connected by the audio plug to switch on the circuit, allowing audio output through the associating signal terminals B.

According to the aforesaid designs, the terminal sets are arranged in the electrically insulative housing A at different elevations, and the bonding endpieces B2 or C2 of an upper terminal set are relatively longer than that of a lower terminal set, i.e., the terminal sets have different sizes. Further, the terminals B and C are respectively made out of a then metal sheet by means of a stamping technique and then bent into shape. This design wastes a big amount of the metal material. Further, because of low structural strength, the narrow elongated bonding endpieces of the terminals can easily be deformed or broken by an external force during installation. Further, because the narrow elongated bonding endpieces of the terminals are arranged in a narrow space, they may be bonded to the circuit board erroneously, resulting a high defect rate. Further, because different stamping dies are necessary for making the signal terminals B and the switching terminals C, the tooling cost is high.

To eliminate the aforesaid problems, an adapter board may be used in an audio jack assembly. According to this design, as shown in FIG. 9, signal terminals B and switching terminals C are bonded to an adapter board D that electrically connects the terminals to the motherboard. This design reduces waste of metal material. However, the use of the adapter board D relatively increases the fabrication cost and complicates the installation procedure. Further, when bonding signal terminals B and switching terminals C to the adapter board D, a bonding error may occur, increasing the defect rate.

Therefore, it is desirable to provide an audio jack assembly that eliminates the drawbacks of the aforesaid prior art designs.

SUMMARY OF THE INVENTION

The present invention has been accomplished under the circumstances in view. According to one aspect of the present invention, the audio jack assembly comprises an electrically insulative housing holding a respective terminal set in each of vertically spaced plug holes thereof, and a locating block fastened to the back side of the housing and holding multiple leads. Each terminal of each terminal set has a base for mounting, a spring arm and/or a retaining portion. Each lead has a top end press-fitted into engagement with the retaining portion of one terminal by means of a machine, and a bottom end for bonding to an external motherboard beneath the housing and the locating block. According to this design, the leads can be coiled copper wires, metal wires or stamped metal strip terminals. By means of the application of a machine, the installation of the terminal sets and the leads is simple and labor saving, and therefore the invention greatly improves the manufacturing efficiency and lowers the defect rate.

According to another aspect of the present invention, the terminals can be directly stamped from metal by means of a same stamping die. Because it is no necessary to stamp a narrow elongated tail end on each terminal for bonding, the invention reduces metal waste, and the finished terminals have better strength. By means of modularized signal terminal and switching terminal design, the invention saves molding cost and greatly lowers terminal fabrication and material cost.

According to still another aspect of the present invention, the arrangement of the terminal sets in the housing and the leads in the locating block to match the terminal sets eliminates the installation drawback of the bonding of terminals to a circuit board as see in the prior art designs, simplifying the installation procedure and lowering the fabrication cost.

DETAILED DESCRIPTION OF THE PREFERRED EMBODIMENT

Figure 1:
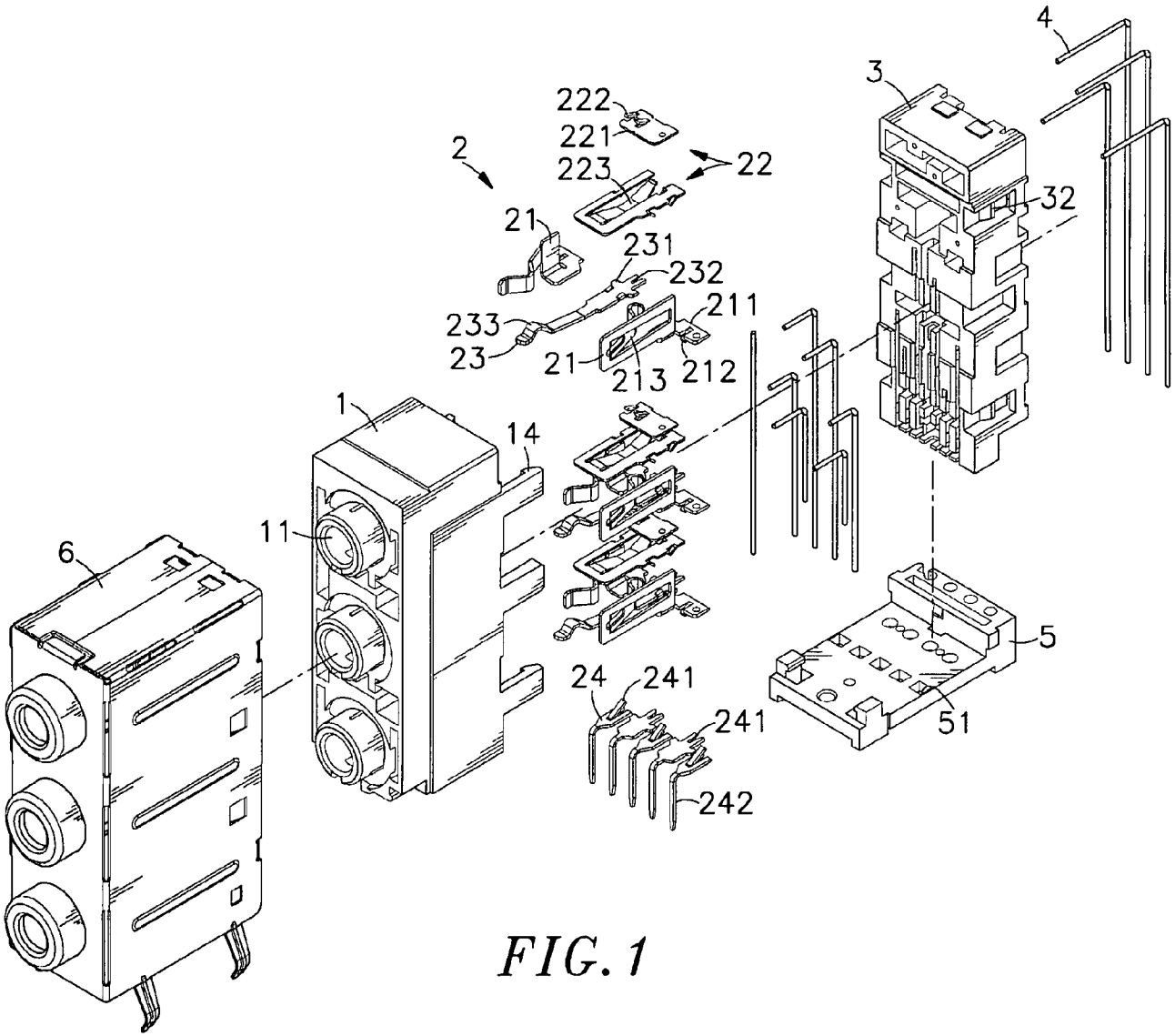
FIG. 1 is an exploded view of an audio jack assembly in accordance with the present invention.
Figure 2:
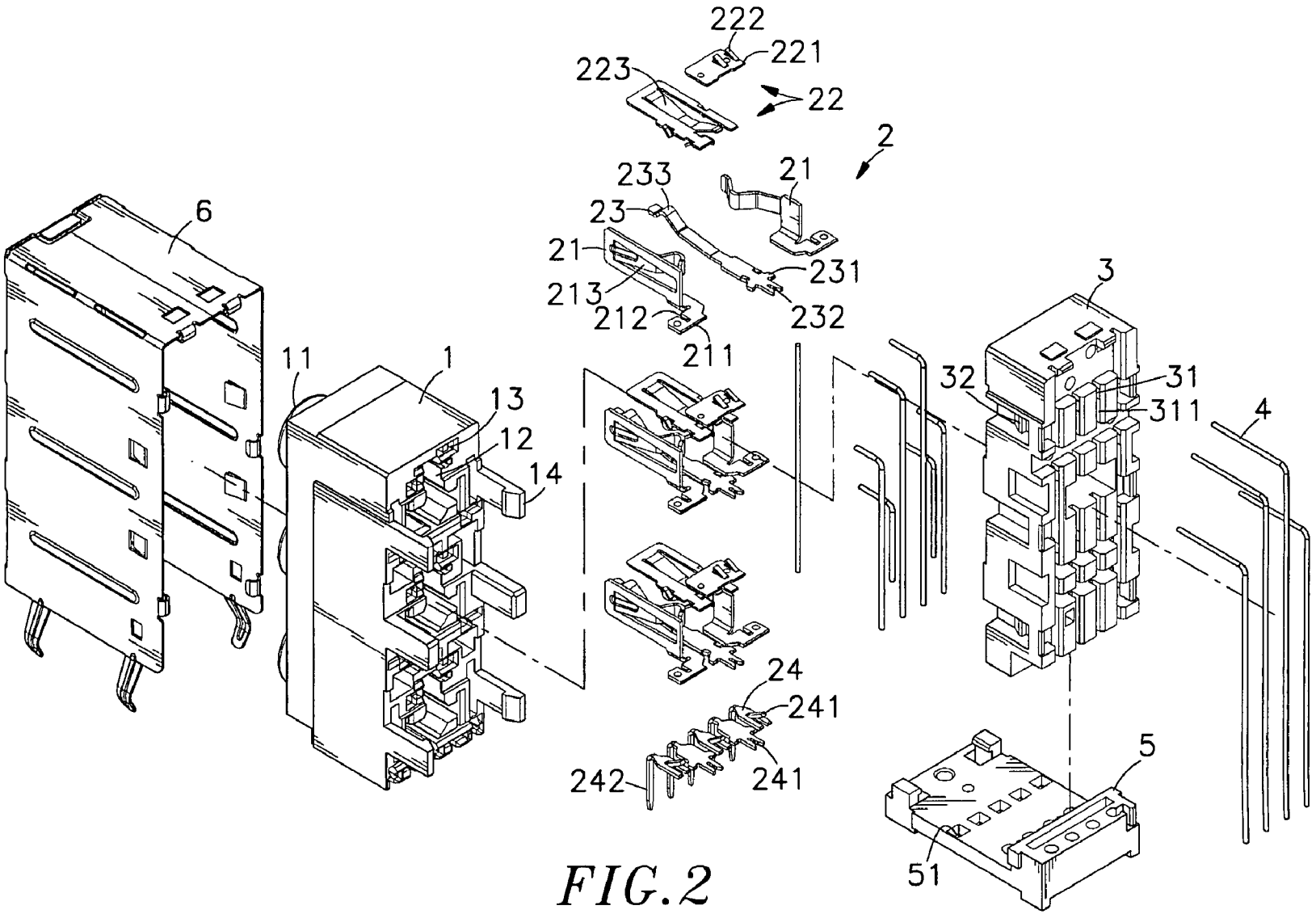
FIG. 2 corresponds to FIG. 1 when viewed from another angle.
Figure 3:
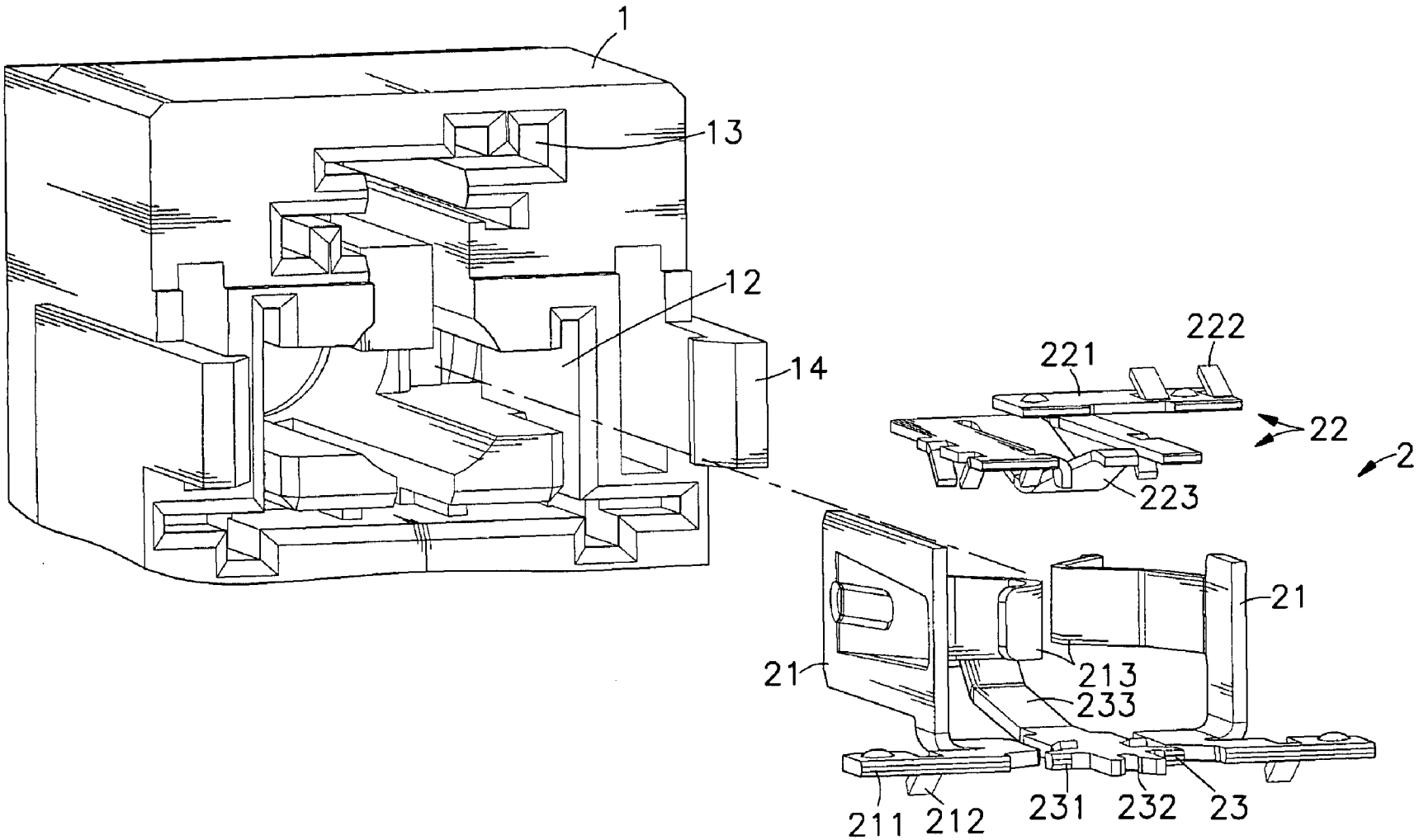
FIG. 3 is an enlarged view of a part of FIG. 2.
Figure 4:
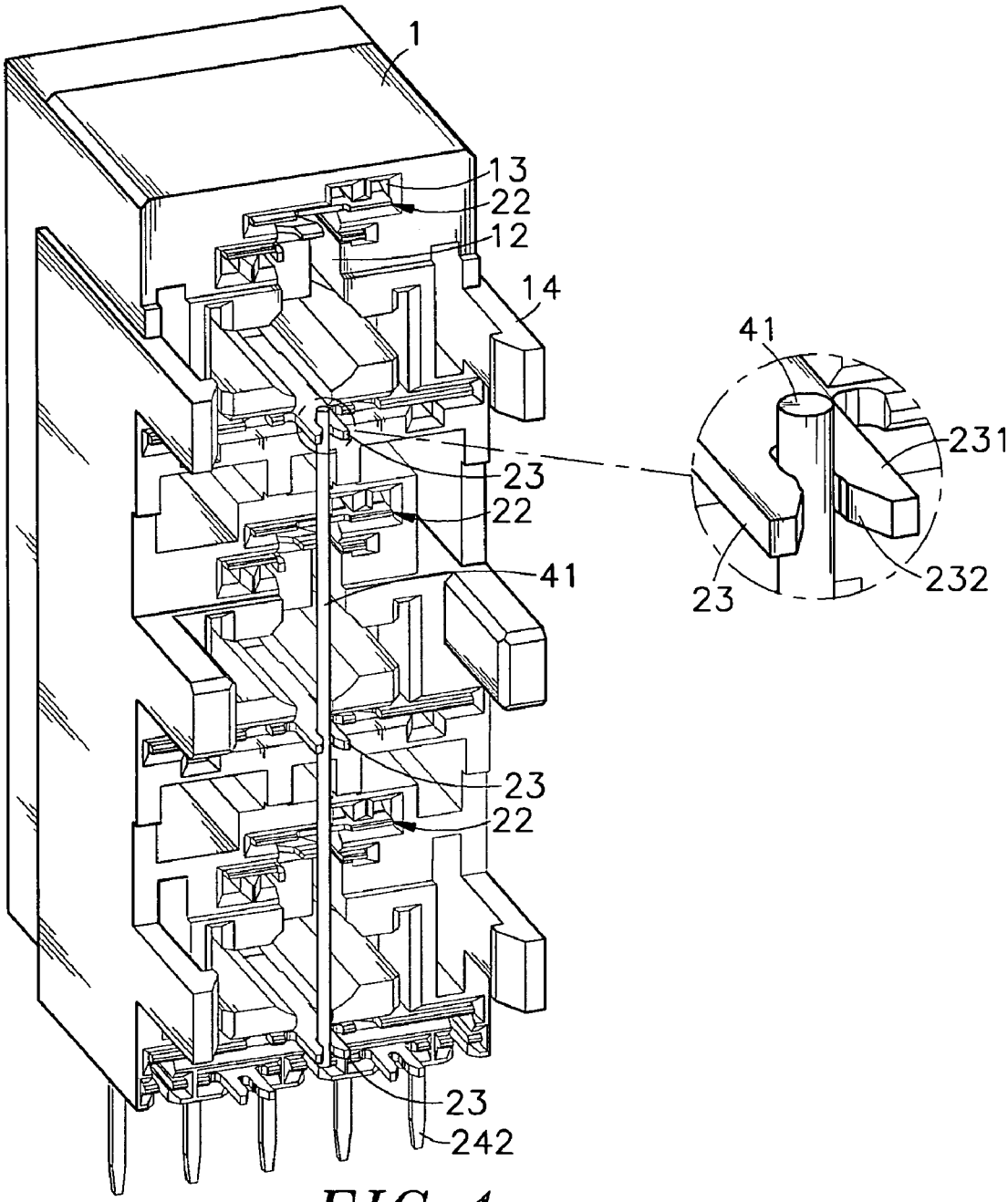
FIG. 4 is a schematic drawing of the present invention, showing the respective lead press-fitted into engagement with the retaining portions of the grounding terminals of the terminal sets in the electrically insulative housing.
Figure 5:
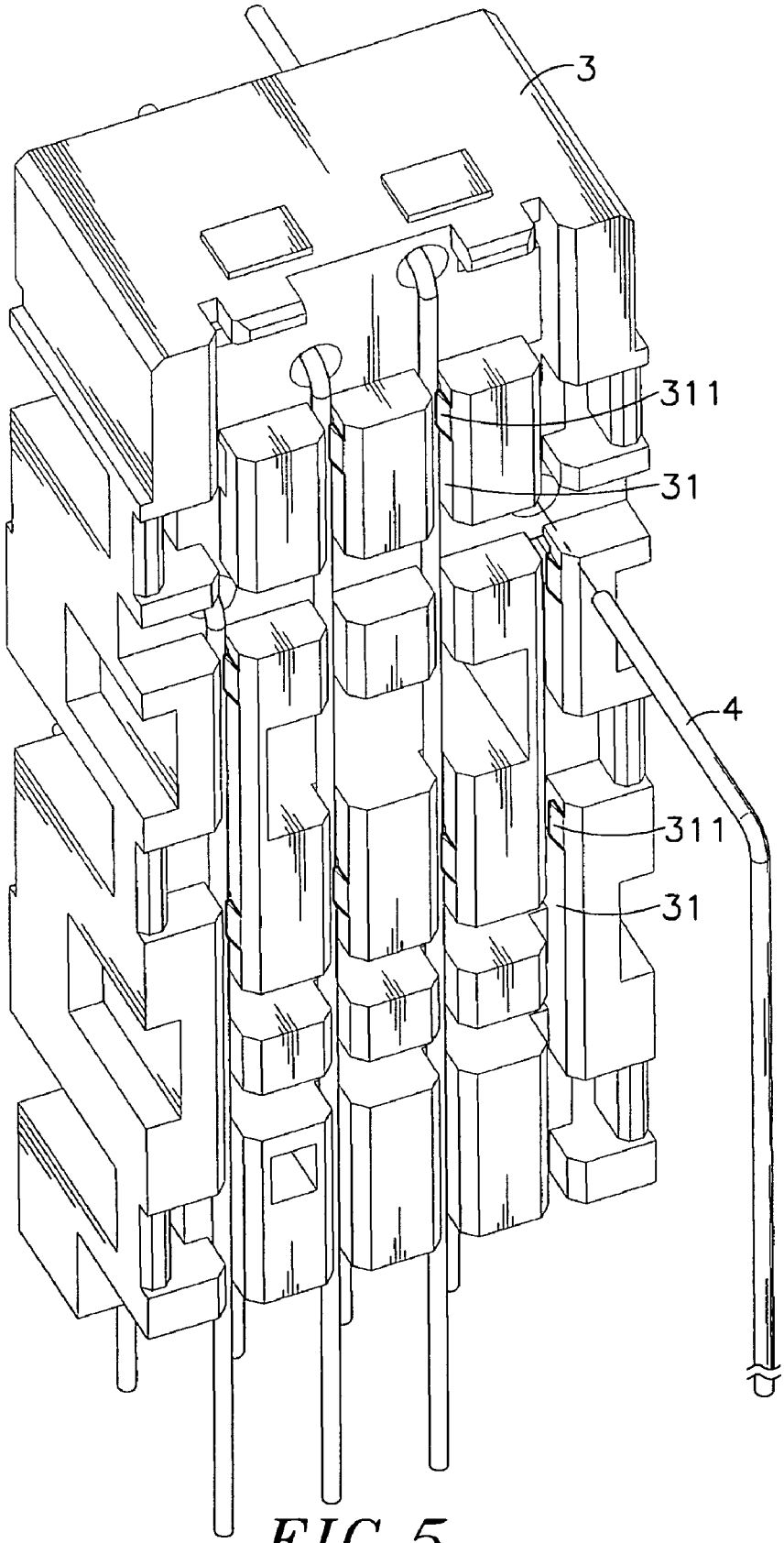
FIG. 5 is a schematic drawing showing installation of leads in the locating block according to the present invention.

Referring to FIGS. 1 and 2, an audio jack assembly in accordance with the present invention is shown comprising an electrically insulative housing 1, multiple terminal sets 2 and a locating block 3.

The electrically insulative housing 1 comprises a plurality of plug holes 11 horizontally forwardly extending to the front side and arranged at different elevations, multiple sets of terminal slots 12 formed in the back side and respectively disposed around and in communication with the plug holes 11 for the mounting of the terminal sets 2, and multiple retaining grooves 13 formed in the back side corresponding to the terminal slots 12, and multiple pairs of back hooks 14 horizontally and bilaterally extending from the back side at different elevations.

The terminal sets 2 are mounted in the terminal slots 12 corresponding to the plug holes 11. Each terminal set 2 includes two signal terminals 21, two switching terminals 22 and one grounding terminal 23. The signal terminals 21 are arranged in parallel at two sides relative to the grounding terminal 23. Each signal terminal 21 has a base 211, a retaining portion 212 protruded from the base 211 at the rear side, and a spring arm 213 extending from the base 211 at the front side and suspending in the corresponding plug hole 11. The two switching terminals 22 are arranged at different elevations, each having a base 221 and a retaining portion 222 protruded from the base 221. Further, the bottom-sided switching terminal 22 has a spring arm 223 extending from the front side of the base 221 thereof and suspending in the corresponding plug hole 11. The grounding terminal 23 is set between the two signal terminals 21, having a base 231, a U-shaped retaining portion 232 protruded from one side, i.e., the rear side of the base 231, and a spring arm 233 extending from the other side, i.e., the front side of the base 231 and suspending in the corresponding plug hole 11.

Further, connecting terminals 24 are arranged at the bottom sides of the housing 1, each having a retaining portion 241 protruded from the top side and a bonding portion 242 extending downwardly.

The locating block 3 is connectable to the back side of the housing 1, having a plurality of lead grooves 31 vertically formed in the front and back sides thereof for the mounting of leads 4, a plurality of retaining portions 311 respectively disposed at two sides of each of the lead grooves 31, and pairs of hooks 32 arranged at two opposite lateral sides of the locating block 3 at different elevations.

After connection of the locating block 3 to the back side of the housing 1, a terminal block 5 is provided at the bottom side of the combination of the housing 1 and the locating block 3, enabling the connecting terminals 24 and the leads 4 to be respectively positioned in the terminal block 5. Further, a metal shield 6 is covered on the housing 1. The metal shield 6 has insertion holes 61 corresponding to the plug holes 11 of the housing 1.

Referring to FIGS. 3 through 7, the terminal sets 2 are respectively mounted in the terminal slots 12 of the housing 1 to engage the retaining portions 212 and 222 of the respective signal terminals 21 and the switching terminals 22 into the corresponding retaining grooves 13 of the housing 1 (see FIG. 3), and then the leads 4 are respectively pressed into tight engagement with the U-shaped retaining portions 232 of the grounding terminals 23. Therefore, one single lead 4 connects the grounding terminals 23 of the multiple (for example, 3) terminal units 2 that are mounted in the vertically spaced plug holes 11 in series for grounding (see FIG. 4).

Figure 6:
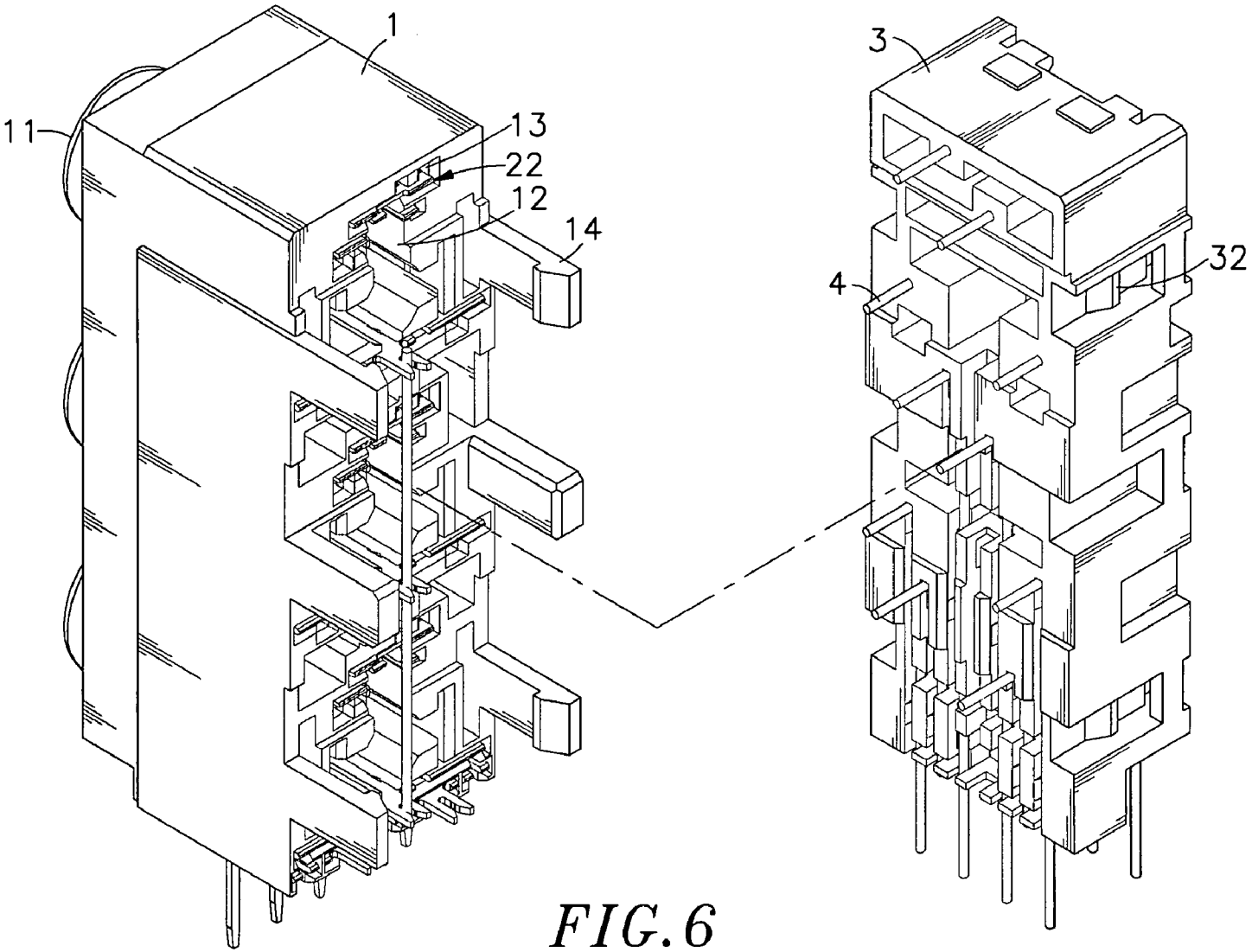
FIG. 6 is a schematic drawing showing the relationship between the electrically insulative housing and the locating block after installation of the terminal sets and the grounding lead in the electrically insulative housing and the respective leads in the locating block.
Figure 7:
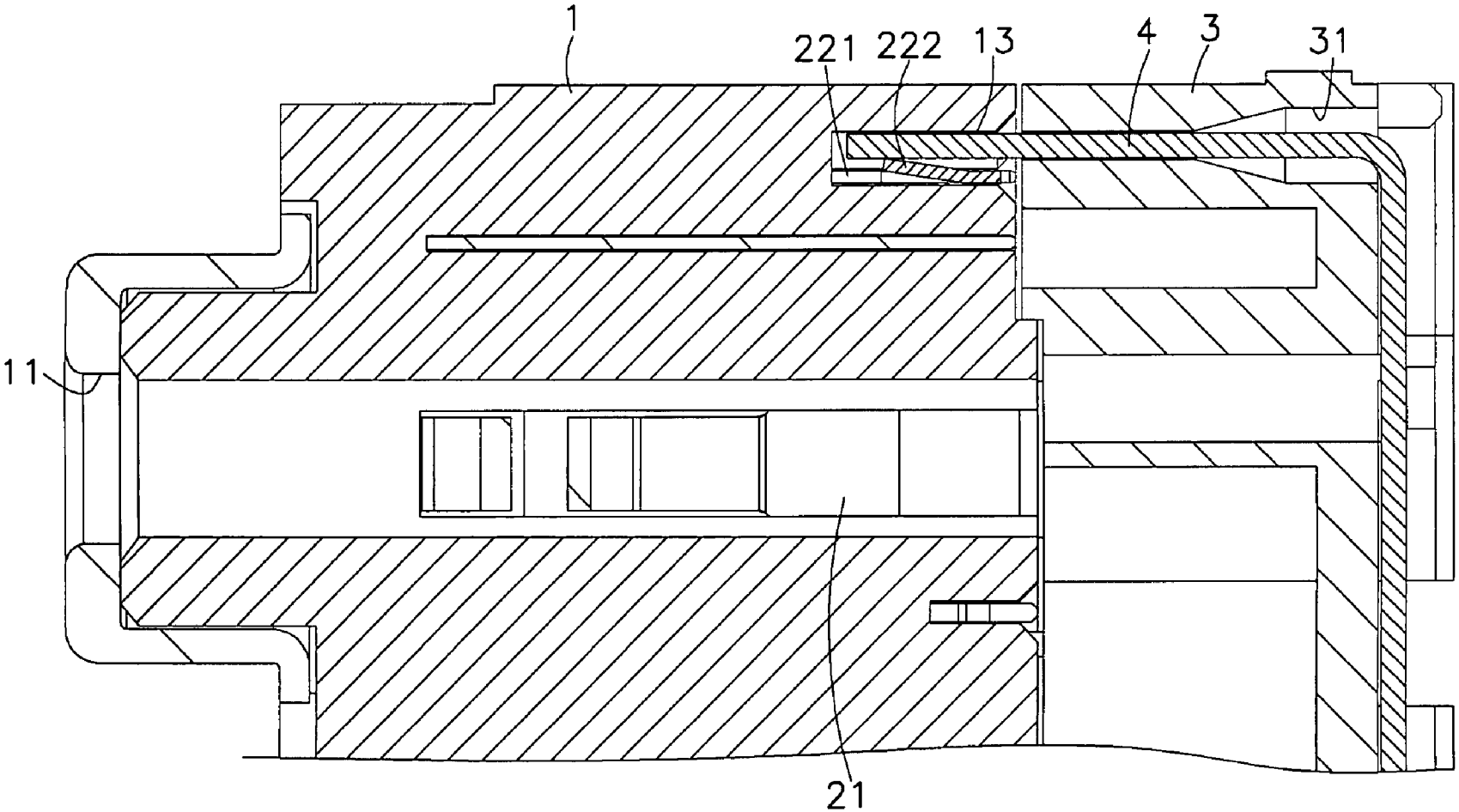
FIG. 7 is a sectional view of a part of the present invention, showing the locating block fastened to the back side of the electrically insulative housing and the lead fastened to the retaining portion of the respective terminal.
Figure 8:
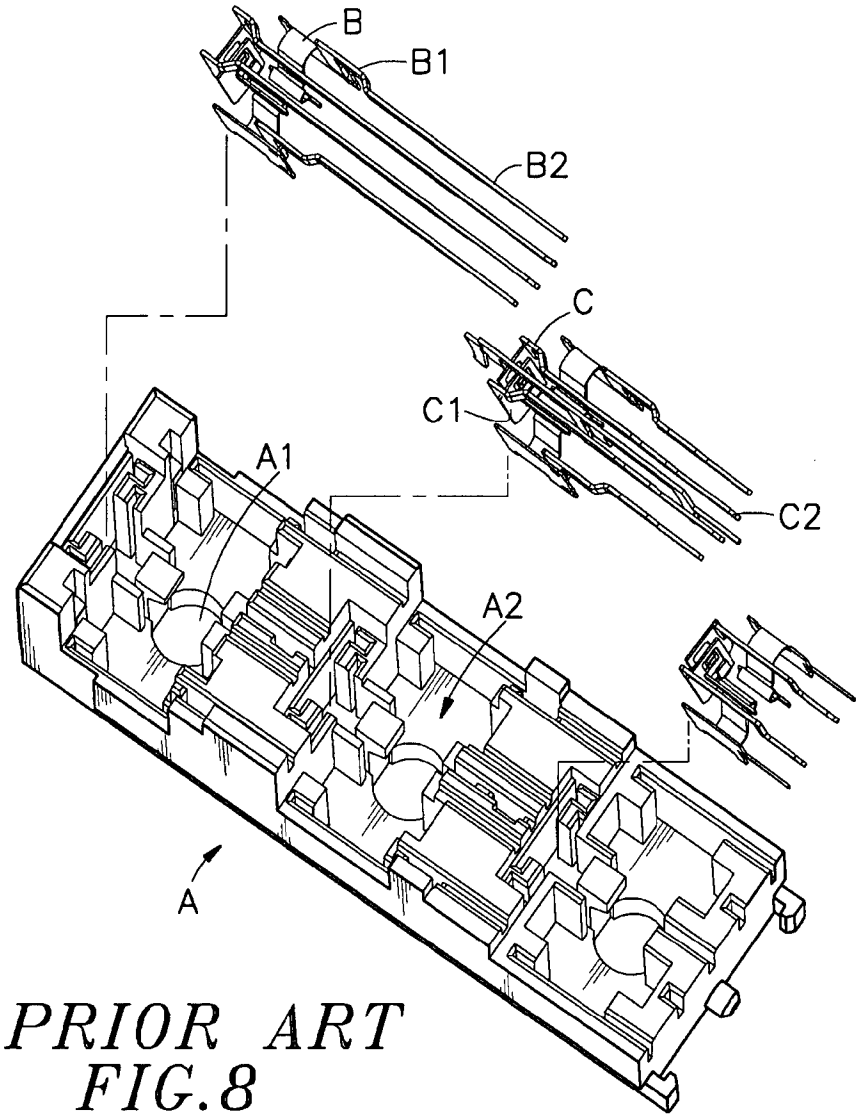
PRIOR ART FIG. 8
FIG. 8 is an exploded view of an audio jack assembly according to the prior art.
Figure 9:
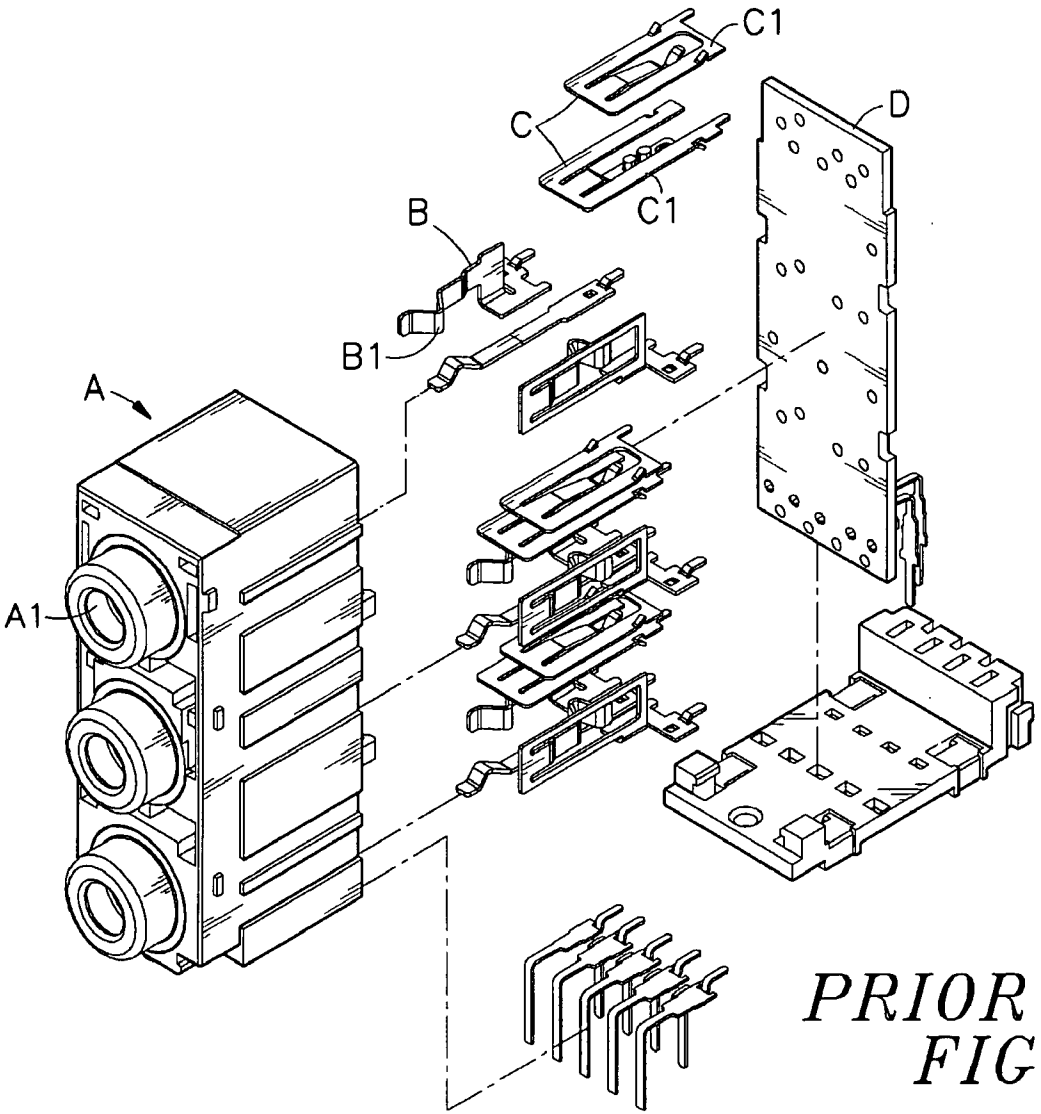
PRIOR ART FIG. 9
FIG. 9 is an exploded view of another structure of audio jack assembly according to the prior art.

Thereafter, the leads 4 are forced through a gap in between each two retaining portions 311 and retained to the lead grooves 31 (see FIG. 5), and then the locating block 3 is fastened to the back side of the housing 1 to force the hooks 32 of the locating block 3 into engagement with the back hooks 14 of the housing 1 (see FIG. 6). After connection of the locating block 3 to the housing 1, the leads 4 that are mounted in the locating block 3 are respectively inserted into the retaining grooves 13 and secured to the retaining portions 212 and 222 of the respective signal terminals 21 and the switching terminals 22 (see FIG. 7), and therefore the leads 4 are respectively and electrically connected to the terminal sets 2.

Further, the connecting terminals 24 are arranged at the bottom sides of the housing 1 to contact the signal terminals 21 in the lowest plug hole 11 of the housing 1 and to force the respective retaining portions 241 into engagement with the corresponding leads 4. This arrangement eliminates the drawback of complicated bending and mounting procedure of the signal terminals 21 and the switching terminals 22 of the lowest terminal set 2 and the corresponding leads 4. Thereafter, the terminal block 5 is provided at the bottom side of the combination of the housing 1 and the locating block 3 to have the connecting terminals 24 and the leads 4 be respectively inserted through respective through holes 51 and electrically bonded to a motherboard (not shown), and at final the metal shield 6 is covered on the housing 1 and affixed thereto, finishing the installation.

Therefore, when an audio plug is inserted into the plug hole 11 of the housing 1, the audio plug pushes the spring arms 213 of the signal terminals 21 and then pushes the spring arm 223 of the bottom-sided switching terminal 22 upwards into contact with the top-sided switching terminal 22, causing the switching terminals 22 to be shifted from OFF status to ON status. At this time, the audio plug has been set in position for audio signal input/output through the signal terminals 21.

According to the aforesaid design, the installation of the switching terminals 22 of the invention meets 5.1 or 7.1 channel audio specification. The switching terminals 22 give an On signal upon insertion of an audio plug, or Off signal after removal of the audio plug. The switching terminals 22 can be made subject to 5.1-channel specifications or 7.1-channel specifications, and then installed in the corresponding terminal slots 12.

In general, the invention provides an audio jack assembly, which has the following features and advantages:

1. The leads 4 in the locating block 3 can be prepared from coiled copper wires or metal wires, or directly stamped from a metal sheet. The leads 4 can be directly fastened to the retaining portions 212 and 222 of the signal terminals 21 and the switching terminals 22 in the retaining grooves 13 by means of a machine, simplifying installation and saving much labor and cost.

2. The terminal sets 2 can be made out of a metal sheet by means of one same stamping die. Because it is not necessary to make a narrow elongated endpiece on each terminal of each terminal set for bonding, the fabrication of the terminal sets reduces waste of metal material, and the modularized design of the signal terminals 21 and the switching terminals 22 saves much tooling cost, and therefore the invention greatly reduces terminal fabrication and material cost.

3. The invention eliminates the use of an adapter board. Therefore the invention avoids the problem bonding of terminals to an adapter board, saves the manufacturing cost, and increases product competivity.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An audio jack assembly comprising:

an electrically insulative housing, said electrically insulative housing comprising a plurality of plug holes for the insertion of a respective audio plug and multiple sets of terminal slots respectively arranged around and disposed in communication with said plug holes;

terminal sets respectively mounted in said multiple sets of terminal slots, each said terminal set comprising at least one signal terminal and at least one switching terminal, each said at least one signal terminal and said at least one switching terminal comprising a base, a retaining portion extending from one side of said base, and a spring arm extending from an opposite side of said base and suspending in the corresponding terminal slot for the contact of an audio plug; and a locating block fastened to a back side of said electrically insulative housing, said locating block comprising a plurality of lead grooves vertically formed in front and back sides thereof, and a plurality of leads respectively mounted in said lead grooves, said leads each having a top end respectively electrically fitted into said retaining portions of said signal terminals and said switching terminals of said terminal sets and a bottom end for electrically bonding to an external motherboard.

2. The audio jack assembly as claimed in claim 1, wherein said leads are coiled copper wires.

3. The audio jack assembly as claimed in claim 1, wherein said leads are prepared from metal wires.

4. The audio jack assembly as claimed in claim 1, wherein said leads are stamped metal strip terminals.

5. The audio jack assembly as claimed in claim 1, wherein said electrically insulative housing comprises a plurality of retaining grooves formed corresponding to said terminal slots for accommodating said retaining portions of the terminals of said terminal sets respectively.

6. The audio jack assembly as claimed in claim 1, wherein each said terminal set comprises two signal terminals arranged in parallel at two opposite lateral sides, each said signal terminal comprising a base, a retaining portion extending from one side of said base of said respective signal terminal, and a spring arm extending from an opposite side of said base of said respective signal terminal and suspending in said corresponding terminal slot for the contact of an audio plug.

7. The audio jack assembly as claimed in claim 1, wherein each said terminal set comprises a lower switching terminal and an upper switching terminal disposed above said lower switching terminal, said lower switching terminal and said upper switching terminal each comprising a base and a retaining portion extending from one side of said base, said lower switching terminal comprising a spring arm extending from one side of said base thereof opposite to said retaining portion thereof and movable for touching said upper switching terminal upon insertion of an audio plug into said corresponding plug hole to touch said respective terminal set.

8. The audio jack assembly as claimed in claim 6, wherein each terminal set further comprises a grounding terminal spaced between said two signal terminals, said grounding terminal comprising a base, a retaining portion extending from one side of said base of said grounding terminal, and a spring arm extending from an opposite side of said base of said grounding terminal and suspending in said corresponding terminal slot.

9. The audio jack assembly as claimed in claim 8, wherein said retaining portion of said grounding terminal has a U-shaped profile for securing one lead by means of press-fitting to have the lead to connect said grounding terminals of said terminal sets into a grounding loop.

10. The audio jack assembly as claimed in claim 1, wherein said locating block comprises a plurality of retaining portions respectively disposed at two sides of each of said lead grooves for securing a respective lead in each said lead groove.

11. The audio jack assembly as claimed in claim 1, further comprising a plurality of connecting terminals respectively kept in contact with said signal terminals of said terminal set in said lowest plug hole of said electrically insulative housing, each said connecting terminal having a top retaining portion for securing one lead been connected with said at least one switching terminal of said terminal sets and a downwardly extending bottom bonding portion for bonding to an external motherboard.

12. The audio jack assembly as claimed in claim 1, wherein said electrically insulative housing comprises a plurality of back hooks bilaterally arranged at different elevations; said locating block comprises a plurality of hooks bilaterally arranged at different elevations and respectively forced into engagement with said back hooks of said electrically insulative housing.

13. The audio jack assembly as claimed in claim 11, further comprising a terminal block fastened to said electrically insulative housing and said locating block at a bottom side, said terminal block comprising a plurality of through holes for the passing of said leads and said downwardly extending bottom bonding portions of said connecting terminals.

14. The audio jack assembly as claimed in claim 1, further comprising a metal shield covered on said electrically insulative housing, said metal shield having a plurality of insertion holes respectively connected to said plug holes of said electrically insulative housing.

* * * * *